US007357847B2

(12) United States Patent
Weigant

(10) Patent No.: US 7,357,847 B2
(45) Date of Patent: Apr. 15, 2008

(54) DEVICE FOR DRYING A PAPER WEB

(75) Inventor: Harald Weigant, Graz (AT)

(73) Assignee: Andritz AG, Graz (AT)

( * ) Notice: Subject to any disclaimer, the term of this patent is extended or adjusted under 35 U.S.C. 154(b) by 497 days.

(21) Appl. No.: 10/923,928

(22) Filed: Aug. 23, 2004

(65) Prior Publication Data

US 2005/0086834 A1 Apr. 28, 2005

(30) Foreign Application Priority Data

Aug. 26, 2003 (AT) ..... A 1337/2003

(51) Int. Cl.
*D21F 5/02* (2006.01)
*F26B 13/00* (2006.01)

(52) U.S. Cl. ..... 162/359.1; 162/116; 162/207; 162/362; 162/364; 34/125; 34/624

(58) Field of Classification Search ..... 162/116, 162/204–207, 358.1, 358.3, 306, 361, 362, 162/364, 359.1; 34/444, 453, 454, 459, 355, 34/382, 125, 611, 618, 623, 624
See application file for complete search history.

(56) References Cited

U.S. PATENT DOCUMENTS

| | | | | |
|---|---|---|---|---|
| 4,144,124 | A * | 3/1979 | Turunen et al. | 162/290 |
| 4,309,246 | A * | 1/1982 | Hulit et al. | 162/113 |
| 5,500,092 | A * | 3/1996 | Schiel | 162/358.3 |
| 5,865,954 | A * | 2/1999 | Laapotti | 162/205 |
| 6,340,413 | B1 * | 1/2002 | Nilsson et al. | 162/361 |
| 6,610,173 | B1 * | 8/2003 | Lindsay et al. | 162/109 |

* cited by examiner

*Primary Examiner*—Eric Hug
(74) *Attorney, Agent, or Firm*—Alix, Yale & Ristas, LLP

(57) ABSTRACT

A device for drying a paper web includes a structured fabric for carrying the paper web rests during the drying process. A single roll unit includes a suction roll for dewatering the paper web and a press roll for securing the paper web to the structured fabric. The paper web is dried by hot air while on a drying drum.

12 Claims, 1 Drawing Sheet

DEVICE FOR DRYING A PAPER WEB

BACKGROUND OF THE INVENTION

The invention relates to a device for drying a paper web, in particular a tissue web, with a structured fabric on which the paper web rests during the drying process, as well as a device for dewatering the paper web, with a mechanism for securing the paper web to the structured fabric, and with a drying drum on which the paper web is dried by hot air.

When a paper web is made, particularly a tissue web, it is dried as part of the production process. During this drying process according to the state of the art, the paper web is held onto a structured fabric by vacuum, after being dewatered first of all to a moisture content of some 22 to 28%, and then brought to a drying drum on which it is dried by hot air.

SUMMARY OF THE INVENTION

The task of the invention is to provide a device that reduces the technical effort and the amount of energy required to dry the paper web.

According to the invention, the paper web is dewatered and secured to a structured fabric, with the liquid being squeezed out at the same time, in a single roll unit comprising a suction roll and a press roll, where the paper web and the structured fabric are carried simultaneously through the press nip formed by these two rolls.

A preferred embodiment of the invention is thus characterized by the paper web being held between the structured fabric and a felt web as it runs between the suction roll and the press roll. The felt web, which is led away again from the paper web adhering to the structured fabric after the roll unit, provides better dewatering of the paper web in the press nip.

There are several possible designs of suction roll that could be used for the purposes of the present invention. On the one hand, a suction unit for the suction roll can be located in the area of the press nip between the press roll and the suction roll.

It is also possible, however, to place a suction unit for the suction roll in the area upstream of the press nip between the press roll and suction roll, or to locate the suction unit of the suction roll largely upstream of the area of the press nip between the press roll and suction roll and extend it into the press nip area.

A particularly preferable embodiment of the invention is characterized by the suction unit having at least two zones with different suction capacities, which leads to particularly intensive dewatering.

A preferred embodiment of the invention is characterized by the press roll being a shoe press roll. Shoe press rolls have proved particularly suitable within the scope of the present invention.

Further characteristic features and advantages of the invention result from the following examples of embodiments of the invention, which refer to the enclosed drawings.

A further preferred embodiment of the invention is characterized by the suction roll forming a pick-up roll. In this embodiment there is no need for a separate pick-up roll, which thus reduces the mounting and maintenance costs of the device.

In the scope of the invention it is also preferable to have a steam blow box located opposite the suction unit. As a result, the plant size can be reduced.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
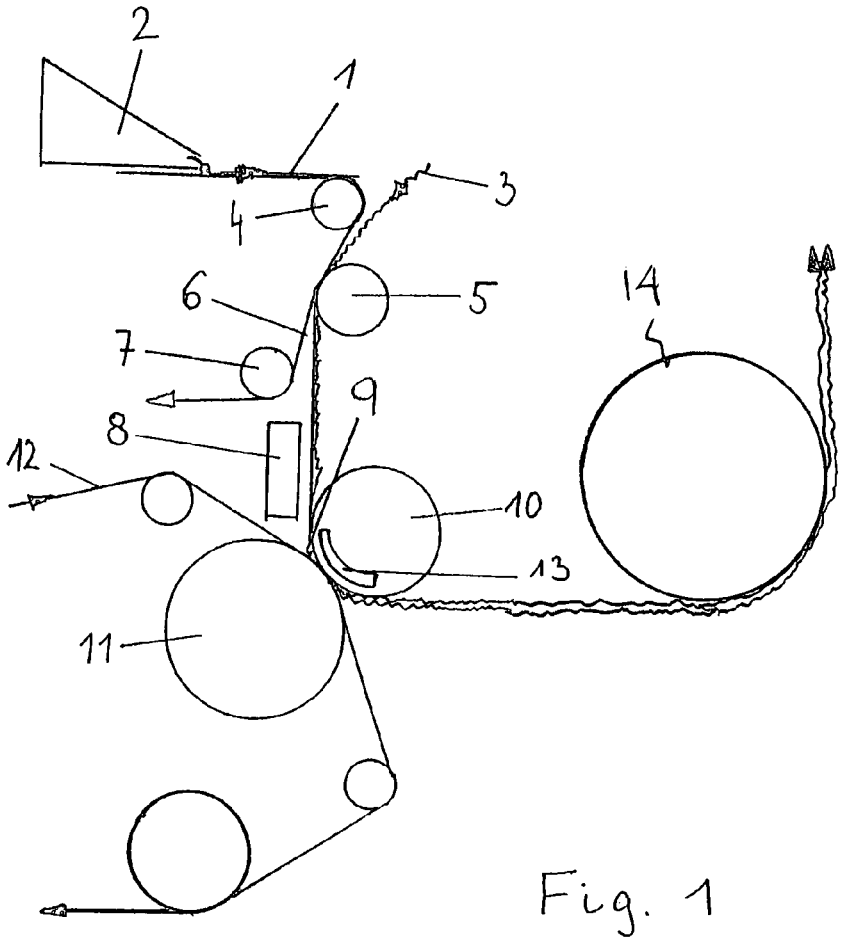
FIG. 1 is a simplified schematic view of a first embodiment of a device for drying a paper web in accordance with the invention.

In FIG. 1, an initial embodiment of the invention is shown in which a paper web 1 leaving a forming unit 2 is carried on a wire 6 and, after passing over a deflection roll 4, converges with a structured fabric 3. The two converge at a pick-up roll 5, after which the wire 6 is guided over a deflection roll 7 away from the paper web again.

Subsequently the paper web 1 is carried by the structural fabric 3 past a steam blow box 8 together with the structured fabric 3 and enters a press nip 9, which is formed between a suction roll 10 and a press roll 11. The press roll can preferably be a shoe press roll or wide nip press roll of the type already known as state of the art.

Before the press nip 9, a further felt web 12 is included so that the paper web 1 is held between the structured fabric 3 and the felt web 12 while moving through the press nip 9.

The suction roll 10 has a suction unit 13 with which part of the water pressed out of the paper web 1 is removed. Another part of the water is absorbed by the felt web 12 and carried away again from the paper web 1 together with this felt web after the press nip 9. After the roll unit consisting of the suction roll 10 and the press roll 11, the paper web 1 is carried on the structured fabric 3 to a drying drum 14, where it is dried by hot air.

Figure 2:
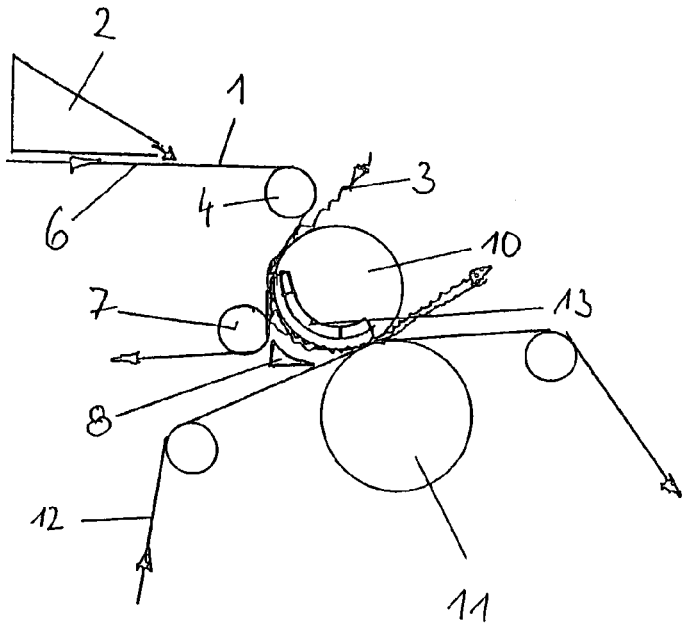
FIG. 2 is a simplified schematic view of a second embodiment of a device for drying a paper web in accordance with the invention.

The embodiment in FIG. 2 differs from that in FIG. 1 largely in that the pick-up roll is formed by the suction roll 10, i.e. the paper web 1 on the wire 6 does not converge with the structured fabric 3 until it reaches the suction roll 10.

In this embodiment the suction unit 13 is designed in three parts, where three zones can be formed in the suction unit 13 with different suction capacities. The steam blow box 8 is located opposite the suction unit 13 in the embodiment shown in FIG. 2.

Dewatering and drying of the paper web 1 then proceeds again as shown in FIG. 1, i.e. the paper web 1 is carried between the structured fabric 3 and a felt web 12 through the roll unit, consisting of the suction roll 10 and the press roll 11, and then brought to the drying drum.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A device for drying a paper web comprising:

a structured fabric adapted for carrying the paper web during the drying process;

a pickup roll biasing the structured fabric whereby the paper web is molded against the structured fabric producing a structured web;

a roll unit receiving the structured fabric and the structured web, the roll unit including a suction roll for dewatering the paper web, the suction roll defining a deflection roll, the structured fabric being in direct contact with the suction roll, and a press roll for securing the paper web to the structured fabric; and a drying drum on which the paper web is dried by hot air.

2. The device of claim 1 wherein the press roll is a shoe press roll.

3. The device of claim 1 further comprising a felt web, the paper web being held between the structured fabric and the felt web as the paper web runs between the suction roll and the press roll.

4. The device of claim 1 wherein the press roll and the suction roll define a press nip therebetween and the suction roll includes a suction unit located proximate to the press nip.

5. The device of claim 1 wherein the press roll and the suction roll define a press nip therebetween and the suction roll includes a suction unit located upstream of the press nip.

6. The device of claim 5 wherein the suction unit of the suction roll extends into the press nip.

7. The device of claim 4 wherein the suction unit has at least two zones, each of the zones having different suction capacities.

8. The device of claim 1 wherein the suction roll is also a pick-up roll.

9. The device of claim 8 wherein the suction roll includes a suction unit and the device further comprises a steam blow box disposed opposite the suction unit.

10. The device of claim 1 further comprising a pick-up roll disposed downstream of the roll unit; and a steam blow box disposed intermediate the pick-up roll and the roll unit.

11. The device of claim 5 wherein the suction unit has at least two zones, each of the zones having different suction capacities.

12. The device of claim 9 wherein the suction unit has at least two zones, each of the zones having different suction capacities.

* * * * *